US007610131B2

(12) United States Patent
Kojima

(10) Patent No.: US 7,610,131 B2
(45) Date of Patent: Oct. 27, 2009

(54) ROLL ANGLE CONTROL DEVICE FOR REMOTE-CONTROLLED TWO-WHEELED VEHICLE

(76) Inventor: Satoru Kojima, Pyuru Rojyuman 101-go, 2430-1, Shosha, Himeji-shi, Hyogo (JP) 671-2201

( * ) Notice: Subject to any disclaimer, the term of this patent is extended or adjusted under 35 U.S.C. 154(b) by 723 days.

(21) Appl. No.: 10/539,752

(22) PCT Filed: Jun. 16, 2003

(86) PCT No.: PCT/JP03/07644

§ 371 (c)(1),
(2), (4) Date: Jun. 20, 2005

(87) PCT Pub. No.: WO2004/054678

PCT Pub. Date: Jul. 1, 2004

(65) Prior Publication Data

US 2006/0085111 A1 Apr. 20, 2006

(30) Foreign Application Priority Data

Dec. 18, 2002 (WO) ..... PCT/JP02/13267

(51) Int. Cl.
*B60G 17/016* (2006.01)

(52) U.S. Cl. ..... 701/38; 701/37; 701/41; 701/2; 446/275; 446/440; 446/457; 446/460; 340/465

(58) Field of Classification Search ..... 701/38, 701/37, 41, 2; 446/440, 288, 233, 456, 275, 446/457; 280/271; 340/465

See application file for complete search history.

(56) References Cited

U.S. PATENT DOCUMENTS 4,267,663 A * 5/1981 Nagahara ..... 446/440

(Continued)

FOREIGN PATENT DOCUMENTS

JP 49-73600 6/1974

(Continued)

*Primary Examiner*—Thomas G Black
*Assistant Examiner*—Wae Louie
(74) *Attorney, Agent, or Firm*—Wenderoth, Lind & Ponack, L.L.P.

(57) ABSTRACT

A rolling angle control device 21 is disposed to provide the rolling angle control device for a remote-controlled two-wheeled vehicle so as to facilitate the control of the vehicle by an operator and stabilize the posture of the remote-controlled two-wheeled vehicle in a wide speed range.

The rolling angle control device 21 is provided with a rolling angle detection means 35 to detect a rolling angle of a vehicle main body, a steering actuator 13 to apply a right- or left-rotational torque to a steering shaft or a front fork, a control means 29 that outputs an operation amount for the steering actuator based on a rolling angle detection value and a rolling angle target value from a remote control receiver so as to bring the rolling angle detection value closer to the rolling angle target value, and a steering angle detection means 50 for detecting to which at least the neutral point as a boundary the steering angle is turned left or right, wherein a caster effect control means 51 is configured such that the control means 29 controls so that a signal is applied to an operation amount for the steering actuator as follows; when a steered angle detected by the steering angle detection means is in the right direction, the right-rotational torque is applied, and, when a steered angle detected by the steering angle detection

2 Claims, 12 Drawing Sheets

U.S. PATENT DOCUMENTS

| | | | | |
|---|---|---|---|---|
| 4,290,228 | A * | 9/1981 | Goldfarb et al. | 446/288 |
| 4,342,175 | A * | 8/1982 | Cernansky et al. | 446/440 |
| 4,480,711 | A * | 11/1984 | Satoh et al. | 180/215 |
| 4,902,271 | A * | 2/1990 | Yoneda | 446/440 |
| 4,966,569 | A * | 10/1990 | Asano | 446/440 |
| 5,515,274 | A * | 5/1996 | Mine et al. | 701/38 |
| 5,709,583 | A * | 1/1998 | Suto et al. | 446/440 |
| 5,742,925 | A * | 4/1998 | Baba | 701/221 |
| 5,820,439 | A * | 10/1998 | Hair, III | 446/233 |
| 6,237,710 | B1 * | 5/2001 | Mori et al. | 180/219 |
| 6,786,796 | B2 * | 9/2004 | Suto | 446/440 |
| 7,006,901 | B2 * | 2/2006 | Wang | 701/1 |
| 7,288,017 | B2 * | 10/2007 | Mukaida, Kenji | 446/440 |
| 7,406,371 | B2 * | 7/2008 | Izawa et al. | 701/37 |
| 2002/0173882 | A1 * | 11/2002 | Tobaru et al. | 701/1 |
| 2006/0047387 | A1 * | 3/2006 | Izawa et al. | 701/37 |
| 2006/0085111 | A1 * | 4/2006 | Kojima | 701/38 |
| 2007/0182123 | A1 * | 8/2007 | Bryant | 280/271 |
| 2008/0077301 | A1 * | 3/2008 | Suzuki et al. | 701/65 |
| 2008/0295595 | A1 * | 12/2008 | Tacklind et al. | 73/462 |
| 2008/0306653 | A1 * | 12/2008 | Hasegawa | 701/38 |

FOREIGN PATENT DOCUMENTS

| | | |
|---|---|---|
| JP | 7-215258 | 8/1995 |
| JP | 2577593 | 5/1998 |
| JP | 11-281672 | 10/1999 |
| JP | 2001-280995 | 10/2001 |
| WO | 94/14511 | 7/1994 |

* cited by examiner

ROLL ANGLE CONTROL DEVICE FOR REMOTE-CONTROLLED TWO-WHEELED VEHICLE

TECHNICAL FIELD

The present invention relates to a rolling angle control device used for a remote-controlled two-wheeled vehicle. The term "a remote-controlled two-wheeled vehicle" encompasses a radio-controlled two-wheeled vehicle.

BACKGROUND ART

The R/C (abbreviation for "radio-controlled," i.e., wireless-controlled) models are prevalent primarily for hobby use including: land vehicles such as four-wheeled vehicles or two-wheeled vehicles; gliding models such as airplanes or helicopters; water sailing models such as ships. A main body (a vehicle body of the four-wheel or two-wheeled vehicle, an airframe of the airplane, or a ship body of the ship) of such R/C models is mounted with an R/C receiver and a steering section having a steering actuator, wherein the steering section is driven by the steering actuator which moves according to the operation of the operation stick of the R/C transmitter by an operator allowing the main body of the running (flying, navigating) model to, for example, rotate.

The steering section of the two-wheeled vehicle generally consists of a steering shaft supported on a front part of a vehicle body (frame) with backward inclination at a predetermined caster angle, a front fork pivotally turning sideways around the steering shaft, a front wheel rotatably supported at the bottom end of the front fork, and the like. In the case of turning left from a straight driving position, by rotating the steering shaft to the right via a handle to turn the front wheel slightly to the right, inertia force tilts (rolls) the vehicle body to the left. From this condition, by turning the front wheel to the left to maintain the appropriate rolling angle, the vehicle will turn left at the turning radius determined by the rolling angle and the vehicle speed. In this way, the two-wheeled vehicle turns due to the rolling of the body caused by the steering part movement.

In a case that the steering shaft is pivotally connected, the righting moment is created by the front wheel alignment (such as the caster angle or the trail amount) when the torque applied to the steering shaft is eliminated, thereby recovering the posture of the vehicle body to the substantially upright position (the rolling angle is approximately 0°) making the vehicle travel straight. If a disturbance such as wind which tries to tilt the vehicle body is applied while traveling straight at a specific speed or higher, the alignment and gyro effect of the front wheel helps to maintain the vehicle body upright against the disturbance so as to maintain a straight traveling condition by autostabilizing the vehicle body as if riding a bicycle with no hands. Such a characteristic is referred to as "autostability." Although even the model two-wheeled vehicle having reduced dimensions and shape of a full-scale vehicle can achieve rough autostability as long as the front wheel alignment is appropriate and the weight of the vehicle body (the main body of the model) is balanced, the gyro effect of the front wheel involving the dynamic stability is insufficient due to the inertia moment of the wheels being smaller compared to a full-scale vehicle and the caster effect involving the static stability (straight traveling performance) is also insufficient due to the inaccuracy of dimensions and vulnerability to the road surface condition.

Moreover, by supporting the steering shaft rotatably to ensure such mechanical autostability, there arises a problem wherein it becomes difficult to achieve the stable traveling condition when the front wheel vibrates due to disturbance by small projections, such as pebbles on the traveling surface, directly involving the front wheel steering angle.

As described above, for controlling the model two-wheeled vehicle remotely using the remote-controller, measures taken mechanically have been limited in relation to the above-described stability characteristic for the two-wheeled vehicle.

On the other hand, the technology related to the posture control of the R/C model two-wheeled vehicle is disclosed in, for example, Utility Model Registration Publication No. 2577593. In this prior art, there is provided an angular velocity sensor to detect the angular velocity of rotation (angular velocity of inclination) around a roll axis of the two-wheeled vehicle body along with the actuator (specifically, the servo motor) to alter the steering angle (direction angle) of the front wheel, so as to output the control signals to the actuator for controlling the angular velocity of inclination of the vehicle body to conform the actual steering angle of the front wheel to the angle (target value) received by the R/C receiver.

However, according to the prior art, while an operator can optionally determine the turning radius of the vehicle body by instructing the front wheel steering angle directly from the R/C transmitter, the traveling condition tends to be unstable due to the difficulty in control to balance the turning radius with the speed and the rolling angle.

For example, while only the turning radius in conjunction with the steering angle needs to be altered to maintain the predetermined rolling angle when the speed changes due to a disturbance while rolling, the rolling angle has to be altered as well to maintain the turning radius (which in conjunction with the steering angle). However, a vehicle body of large mass has to be displaced to alter the rolling angle, thereby causing slow reaction and difficulty in control.

Particularly, under a condition that the steering angle is small (the turning radius is large) when traveling at high speed, the deflection of the steering angle greatly affects the turning radius and thus the rolling angle in conjunction therewith, resulting in the instability of the vehicle body.

To solve the above-described problems of the prior art, the present inventor has carried out various studies regarding the control device of the R/C two-wheeled vehicle and, as a result, achieved the present invention from comprehension that stable posture control can be achieved by using the rolling angle of the model main body as a controlled variable instead of the steering angle of the steering section by complementing or replacing the above-described autostability with electrical control.

That is, an object of the present invention is to provide a rolling angle control device of an R/C traveling body such as an R/C model which facilitates the control of the vehicle body by an operator and to stabilize the posture of such as an R/C two-wheeled vehicle body in a wide speed range from low-speed to high-speed.

DISCLOSURE OF THE INVENTION

To achieve the above-described object, a rolling angle control device for an R/C two-wheeled vehicle according to the present invention is characterized in that it is provided with:

a vehicle main body, a steering shaft supported on the front section of the vehicle main body at a predetermined caster angle, a front fork to support a front wheel and pivotally rotatable around the steering shaft, a steering actuator being able to apply a rotational torque in either the left/right direction to the steering shaft or the front fork, a rear wheel disposed at the rear section of the vehicle main body and rotationally driven by a prime motor, and a remote control receiver mounted on the vehicle main body, comprising:

a rolling angle detection means to detect the rolling angle of the vehicle main body;

a control means to output an operation amount of the steering actuator based on the detected rolling angle value by the rolling angle detection means and a rolling angle target value from the remote control receiver so as to bring the detected rolling angle value closer to the rolling angle target value; and a steering angle detection means to detect to which at least the neutral point as a boundary the steering angle is turned left or right;

wherein the control means is configured to apply a signal to the operation amount for the steering actuator, the signal is to apply a right-rotational torque to the steering shaft or the front fork via the steering actuator when the steering angle detected by the steering angle detection means is in the right direction, or to apply a left-rotational torque to the steering shaft or the front fork via the steering actuator when the steering angle detected by the steering angle detection means is in the left direction.

The present invention is further characterized in that:

the rolling angle detection means is configured by an angular velocity sensor to detect the angular velocity of rotation of the vehicle main body around the roll axis and an integration means to calculate the rolling angle of the vehicle main body by integrating a detected angular velocity value obtained from the angular velocity sensor, comprising:

a target value determination means to determine whether the rolling angle target value received by the remote control receiver is 0°; and an error correction means to make correction to decrease absolute value of the integral value of the integration means when the target value determination means determines that the rolling angle target value is 0°.

As used herein, the term "a remote-controlled two-wheeled vehicle" is not limited to a model two-wheeled vehicle, but encompasses a two-wheeled vehicle a human can ride as long as its rolling angle or steering angle is configured to be electrically controllable.

"A rolling angle" refers to the angle, indicated by $\theta_r$ in FIG. 4, formed by a vertical line in the gravity direction and the longitudinal center line of the model main body (vehicle body 2). "An angular velocity of rotation around the roll axis" refers to an inclination angle in the rolling direction of the model main body (vehicle body 2).

"A steering angle" is refers to, when the direction of the front wheel of the straight traveling model main body (vehicle body 2) is set at 0°, the clockwise direction when viewed in a plane is a positive steering angle (right-turn direction) and the counterclockwise direction is a negative steering angle (left-turn direction).

DETAILED DESCRIPTION OF THE INVENTION

Overall Side View of an R/C Model Two-Wheeled Vehicle

A rolling angle control device of an R/C model according to an embodiment of the present invention will be described hereinbelow together with an R/C model two-wheeled vehicle provided with the device.

Figure 1:
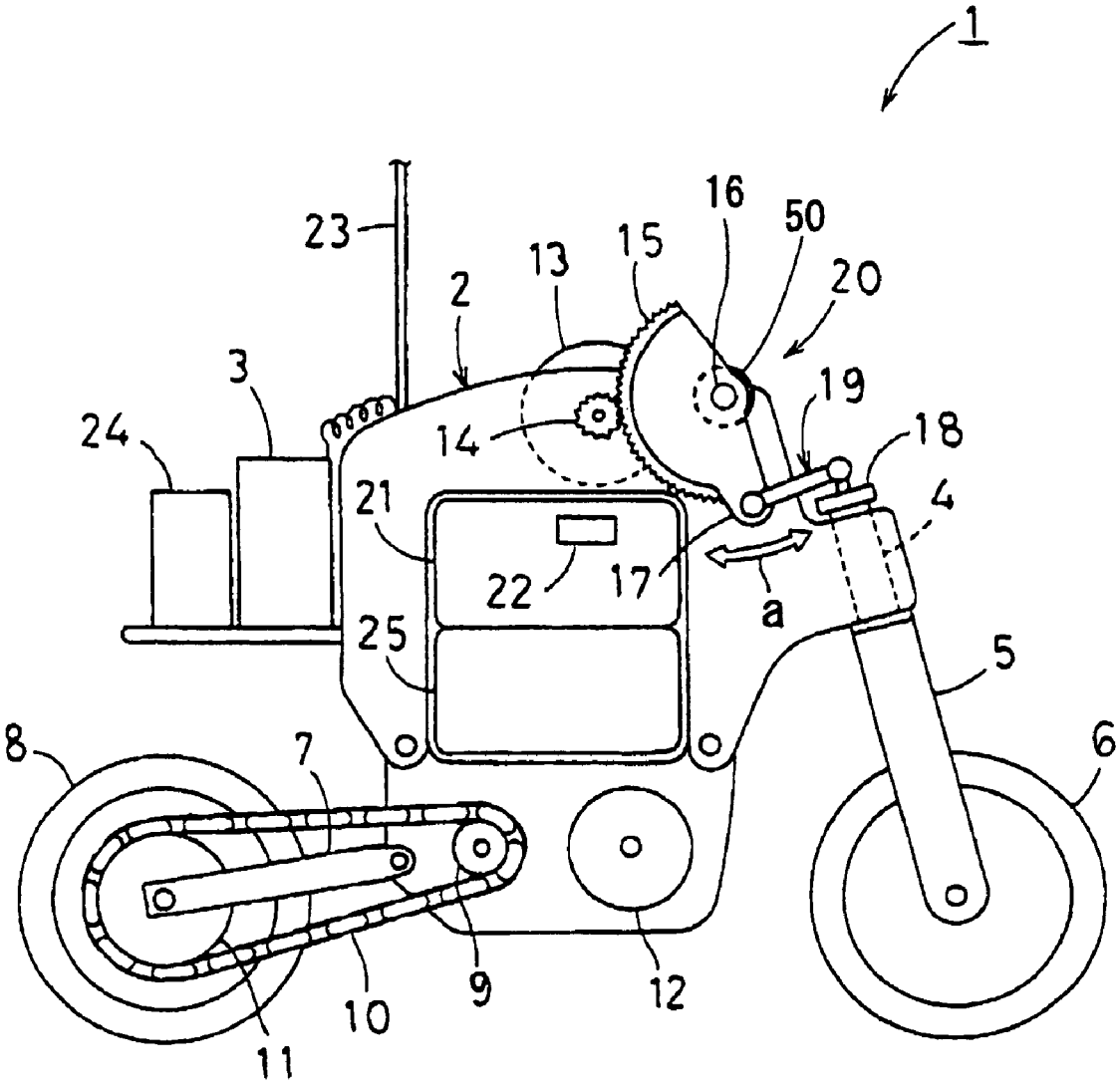
FIG. 1 is a side view of an R/C model two-wheeled vehicle provided with a rolling angle control device according to an embodiment of the present invention.

Reference numeral 1 in FIG. 1 generally denotes the R/C model two-wheeled vehicle according to the embodiment. The R/C model two-wheeled vehicle 1 is provided with a vehicle body 2 (a model main body) as a traveling body; an R/C receiver 3 mounted on the vehicle body 2; a steering shaft 4 pivotally supported on a front part of the vehicle body 2 with backward inclination at a predetermined caster angle; a front fork 5 continuously disposed under the steering shaft 4 and pivotally turning sideways around the steering shaft 4; a front wheel 6 rotationally supported at the bottom end of the front fork 5; a rear wheel 8 rotationally supported at the rear part of the vehicle body 2 via a rear arm 7; and a driving motor 12 (prime motor) to rotationally drive the rear wheel 8 via a gear box (not shown), a driving sprocket 9, a driving chain 10, and a driven sprocket 11.

Figure 3:
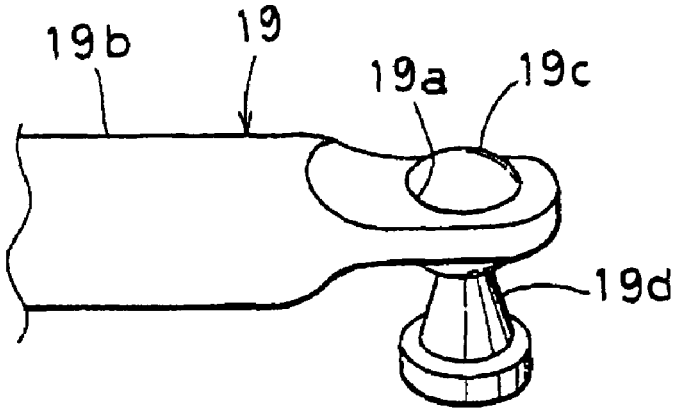
FIG. 3 is a perspective view of a relevant part showing a structure of a ball link.

Reference numeral 13 denotes a steering motor mounted on the vehicle body 2. A pinion gear 14 is secured to a motor shaft of a steering motor 13, and a reduction gear 15 having a sector form which mates with the pinion gear 14 is rotatably pivoted to the vehicle body 2 around a horizontal axis via a supporting shaft 16. While the reduction gear 15 is integrally formed with an arm portion 17, a handle arm 18 in the form of a plate which is secured to an upper end of the steering shaft 4 is connected with the arm portion 17 via a ball link 19. As can be seen in FIG. 3, the ball link 19 is configured with: a link body 19*b* in the form of a bar having ball receiving portions 19*a* on its both ends, wherein the inner surfaces of the ball receiving portions 19*a* are made to be spherical sliding surfaces; and a pair of securing portions 19*d* each positioned on the either ends of a link body 19*b* and coupled thereto in an angularly displaceable manner via a spherical body 19*c* fitted into the ball receiving portion 19*a* to form a ball joint. The securing portion 19*d* on one end is secured to the arm portion 17, and the securing portion 19*d* on the other end is secured to the handle arm 18.

Figure 2:
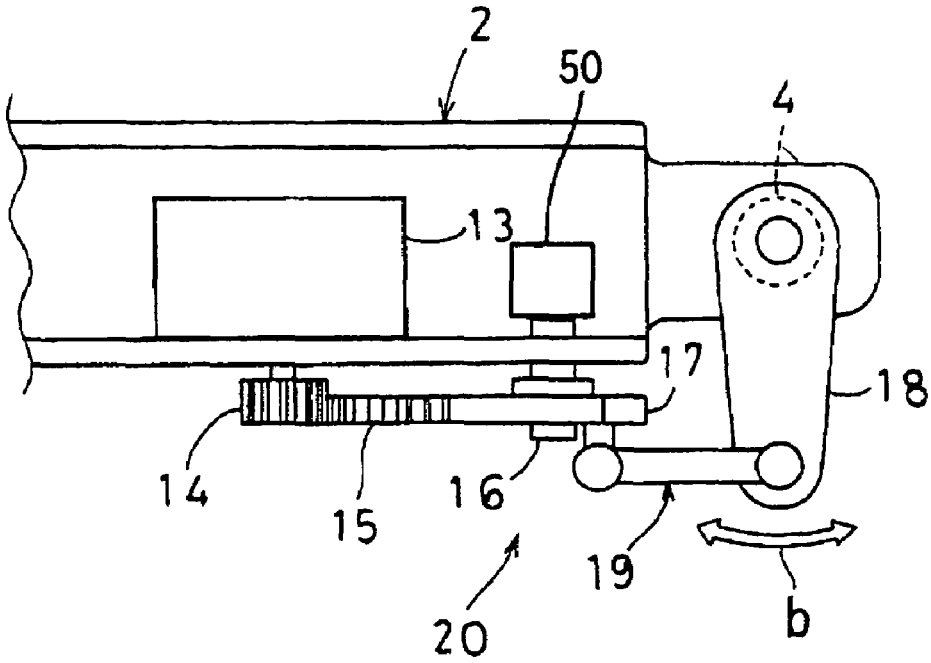
FIG. 2 is a schematic plan view of an enlarged relevant part of the R/C model two-wheeled vehicle mainly shows a front-wheel steering section.

With the respective members described above, a front wheel steering section 20 (steering section) is configured to rock in the direction indicated by an arrow a in FIG. 1 when the steering motor 13 rotates in the positive/negative direction to rock the end of the handle arm 18 in the direction indicated by an arrow bin FIG. 2, thereby pivotally rotating the steering shaft 4, the front fork 5, and the front wheel 6 in the left/right direction around the axis of the steering shaft 4.

As the steering motor 13, a DC motor is applied which generates a rotational torque substantially proportional to the current value flowing in the motor.

The gear ratio of the pinion gear 14 of the motor shaft and the reduction gear 15 is set to be able to obtain the required torque to rotate the steering shaft 4.

Thereby, the configuration is achieved to apply the rotational torque in the positive/negative direction to the steering shaft 4 from the steering motor 13 via the reduction gear 15, the ball link 19, the handle arm 18 and the like.

Reference numeral 21 in FIG. 1 denotes a rolling angle control device to control the rolling angle of the vehicle body 2. The rolling angle control device 21 is provided with an angular velocity sensor 22 (a vibration gyro is used in this embodiment) to detect the angular velocity of rotation of the vehicle body 2 around the roll axis, a DC amplifier which is later described, a microcomputer, steering amplifier (not shown in FIG. 1) and the like. Moreover, in FIG. 1, reference numeral 23, 24, and 25 denote a receiving antenna attached to the R/C receiver 2 to receive the operation signal from an R/C transmitter (not shown) operated by the operator, a driving amplifier to output a driving current to the driving motor 12 based on the signal from the R/C receiver 3, and a battery mounted in the vehicle body 2 as a power source, respectively. Furthermore, the symbol G in FIG. 4 denotes a ground (a road surface) which the R/C model two-wheeled vehicle 1 travels thereon. In this embodiment, a two-channel transmitter provided with two operation sticks for respectively controlling the speed and rolling angle as the R/C transmitter is employed.

Reference numeral 50 denotes a steering angle sensor configured with, for example, a rotary potentiometer, wherein the rotation axis thereof is coaxially disposed with the steering shaft 4 or the reduction gear 15, or is attached via a rotation amount transmission device such as a gear.

Description of Hardware for Control

Figure 5:
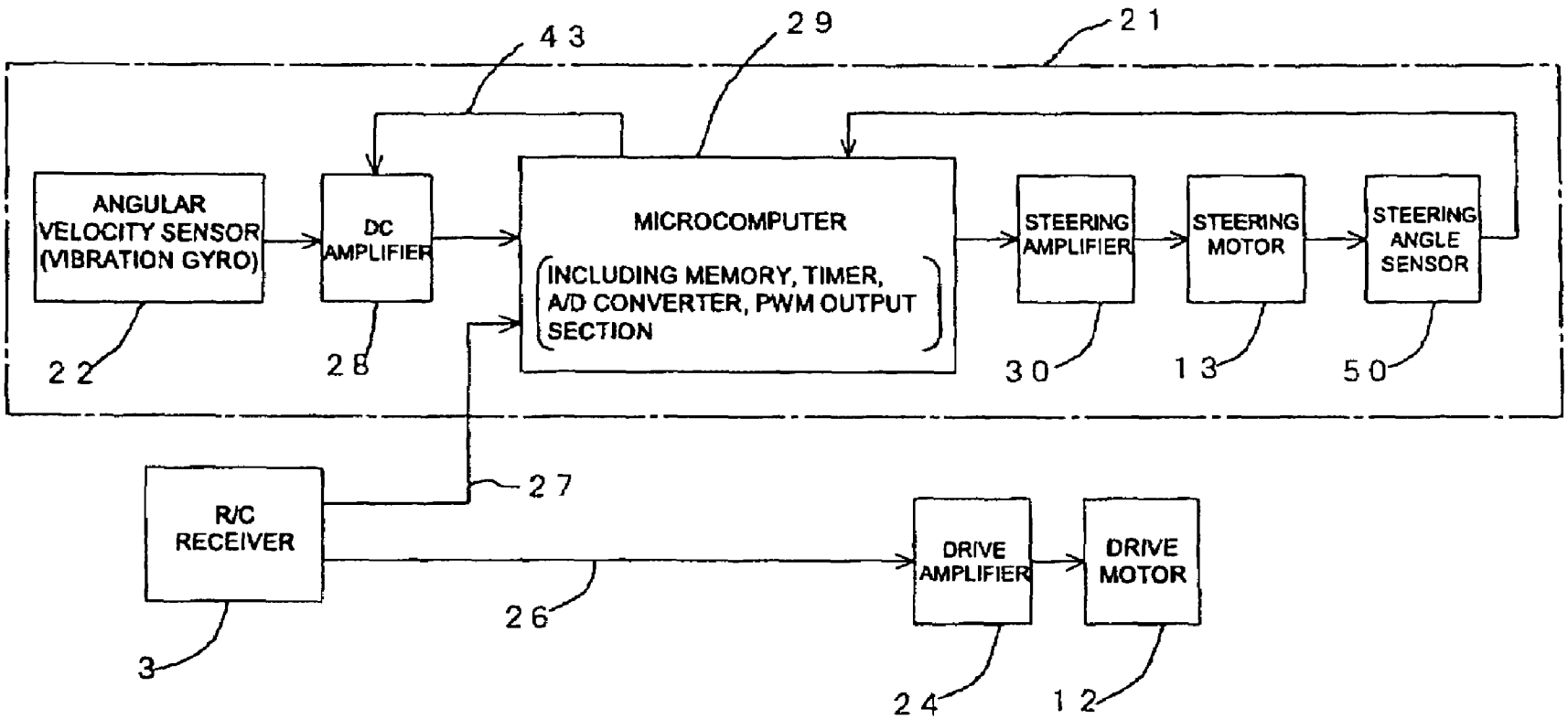
FIG. 5 is a schematic configuration of a hardware related to a traveling control of the T/C model two-wheeled vehicle.

Next, by referring to FIG. 5, a hardware configuration is described related to the travel control (the speed control and the rolling angle control) of the R/C model two-wheeled vehicle 1.

The R/C receiver 3 is configured to receive the operation signal from the R/C transmitter (not shown) and output, in response to the received signal, a speed target value and a rolling angle target value to the driving amplifier 24 and the rolling angle control device 21, respectively, as PWM (pulse width modulation) signals 26 and 27.

The driving amplifier 24 then outputs the current to the driving motor 12 based on the speed target value from the R/C receiver 3, and the driving motor 12 rotationally drives the rear wheel 8 based on the output for the vehicle body 2 to travel at a speed based on the speed target value. An open-loop control is applied for the speed control.

On the other hand, the rolling angle control device 21 is provided with the steering angle sensor 50, the angular velocity sensor 22, a DC amplifier 28 to amplify the output signal from the angular velocity sensor 22, a microcomputer 29 to perform a predetermined arithmetic processing based on the input signal from the steering angle sensor 50, the DC amplifier 28 and the R/C receiver 3, and a steering amplifier 30 to output a current to the steering motor 13 based on the output signal from the microcomputer 29.

The output from the angular velocity sensor 22 is a voltage (an analog value) which is amplified by the DC amplifier 28 and then input into the microcomputer 29 including an A/D converter and the like.

It is configured that a predetermined stable constant voltage is applied to an input terminal of the potentiometer forming the steering angle sensor 50 and the voltage in response to the rotation amount of the rotation shaft can be obtained as a voltage signal corresponding to the steering angle from the output terminal of the potentiometer. The voltage signal (the analog value) obtained in this manner is input into the microcomputer 29 including the A/D converter and the like.

The microcomputer 29 is configured with, along with a CPU, a one-chip microcomputer containing a memory such as a ROM or RAM, an input/output port, a timer, an A/D (analog/digital) converter, a PWM output part which is a kind of a D/A converter and the like integrated on a single chip, wherein the ROM has a program to execute a processing procedure (an algorithm) shown in a later-described flowchart of FIG. 7 pre-stored therein. The microcomputer 29 is also configured to generate a control signal based on the output from the steering angle sensor 50, the output from the angular velocity sensor 22 which is input via the DC amplifier 28 and the rolling angle target value which is input as the PWM signal 27 from the R/C receiver 3, and outputs the control signal from the PWM output part to the steering amplifier 30.

Description of Block Diagram

Figure 6:
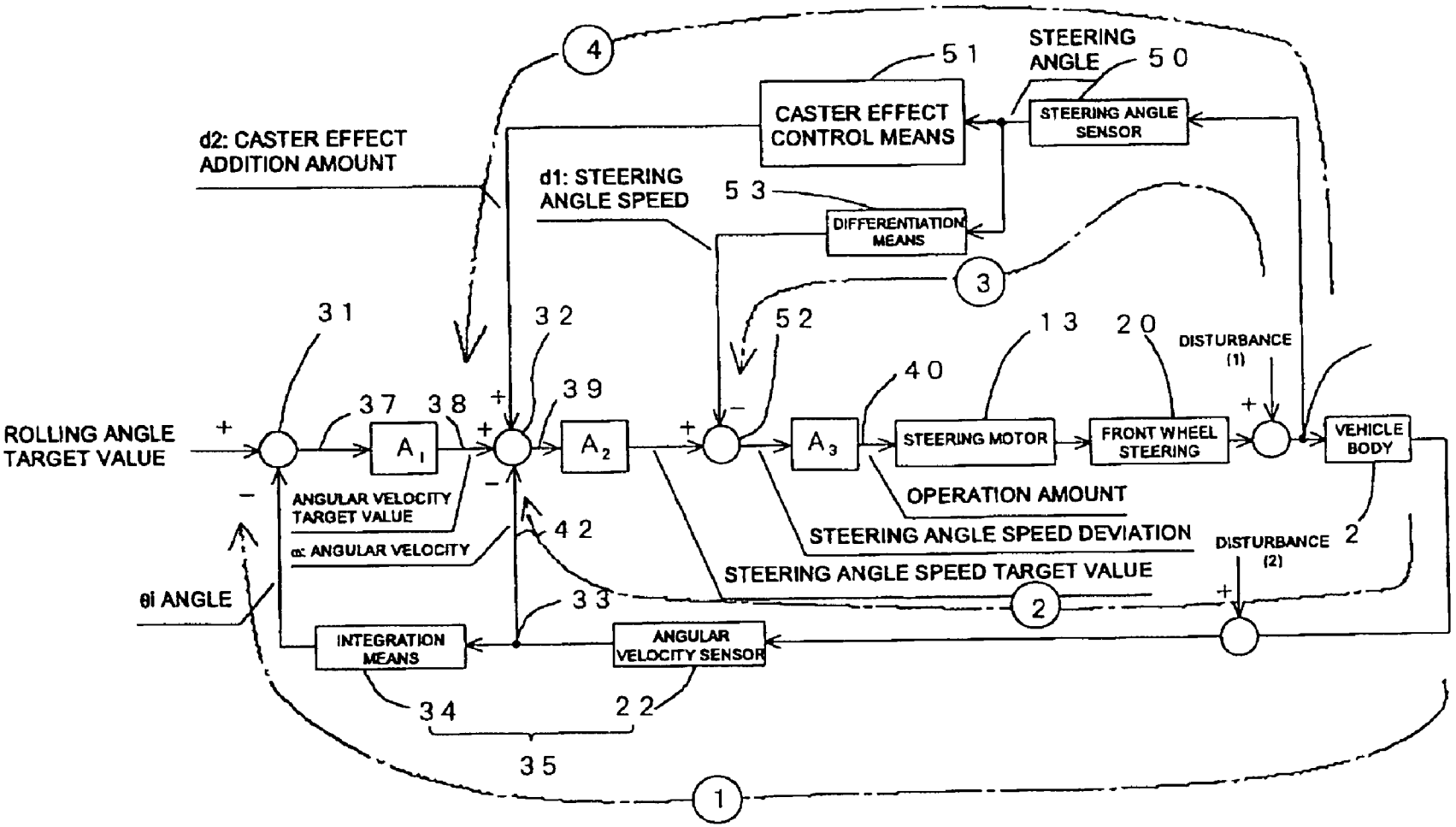
FIG. 6 is a block diagram schematically illustrating a controlling operation by the rolling angle control device.

FIG. 6 is a block diagram schematically illustrating a rolling angle controlling operation of the R/C model two-wheeled vehicle 1 by the rolling angle control device 21, wherein the reference numerals 31, 32, and 52 denote additive summary points, 33 and 54 denote subtractive summary points, and $A_1$, $A_2$, and $A_3$ denote proportionality constants, respectively. Moreover, reference numeral 34 denotes integration means to calculate the rolling angle $\theta_i$ of the vehicle body 2 by integrating the angular velocity $\omega$ (the detected value) obtained from the output of the angular velocity sensor 22. The integral action of the integration means 34 is achieved by the microcomputer 29 executing a predetermined program, and this integration means 34 and the angular velocity sensor 22 constitute a rolling angle detection means 35 of the present invention.

Reference numeral 51 denotes a caster effect control means to output a caster effect addition amount d2 to the additive summary point 32, wherein the caster effect addition amount d2 is such that it applies the right-rotational torque when the steering angle detected by the steering angle sensor 50 is in the right direction or applies the left-rotational torque when the steering angle is in the left direction.

A disturbance (1) is an element such as a pebble or a vertical groove which negatively affects the direct movement of the front wheel. The autostability provided by the gyro effect of the front wheel or the caster effect can be considered as a positive disturbance. A disturbance (2) is an element such as wind which directly disturbs the control amount (the rolling angle).

Furthermore, a control loop (1) is constituted by the vehicle body, the angular velocity sensor, the integration means, the additive summary point 31 to the vehicle body referred to as an angle control loop; a control loop (2) constituted by the vehicle body, the angular velocity sensor, the additive summary point 32 to the vehicle body referred to as an angular velocity control loop; a control loop (3) constituted by the subtractive summary point 54, the steering angle sensor, the differentiation means, the additive summary point 52 to the subtractive summary point 54 referred to as a steering angle speed control loop; and a control loop (4) constituted by the subtractive summary point 54, the steering angle sensor, the caster effect control means, the additive summary point 32 to the subtractive summary point 54 referred to as a steering angle control loop.

A rolling angle control action can be outlined based on FIG. 6 as follows. In the following description, a basic configuration excluding the steering angle speed control loop (3) and the steering angle control loop (4) is described.

First, the rolling angle $\theta_i$ detected by the rolling angle detection means 35 is subtracted from the rolling angle target value input by the R/C receiver 3 to obtain an angular deviation 37 between the rolling angle $\theta_i$ (the detected value) and the rolling angle target value. Next, the angular velocity $\omega$ (the detected value) is subtracted from the angular velocity target value 38 obtained by multiplying the angular deviation 37 by the proportionality constant $A_1$ to obtain an angular velocity deviation 39. Then, the current based on an operation amount 40 obtained by multiplying the angular velocity deviation 39 by the proportionality constants $A_2 \times A_3$ to the steering motor 13 is output. The front wheel 6 is thereby steered via the front wheel steering section 20 causing the vehicle body 2 to be rolled. The angular velocity of rotation of the vehicle body 2 around the roll axis at this time is detected by the angular velocity sensor 22 to feed the angular velocity $\omega$ (the detected value) back to the additive summary point 32 and to feed the rolling angle $\theta_i$ (the detected value) obtained by integrating the angular velocity $\omega$ back to the additive summary point 31.

In this way, the rolling angle control can be achieved in principle by only the feedback control with two closed loops, i.e., the angle control loop (1) and the angular velocity control loop (2).

In a transmission route from "the rolling angle target value," the constant, the steering motor to the front wheel, the configuration of a wiring, the gears and the links are provided such that, for example, the route from the steering motor to the front wheel always turns "left" when the rolling angle target value instructing to "incline to the right at 30°" is provided. Due to such a configuration, the vehicle body behaves as if it is "tricked" in the right direction. In this manner an "inverse turn" configuration specific to the two-wheeled vehicle is achieved.

Furthermore, in FIG. 6, the steering speed control loop (3) is a minor loop to detect the steering speed through the differentiation means 53 utilizing the steering angle sensor 50 to control the operation amount so as to conform the steering speed to the steering speed target value.

This loop is for providing resistivity against the disturbance (1) (which also decreases the influence to autostability), and for initiating the steering section (the actuator to the front wheel) to rotate sooner in response to the steering speed target value and controlling the rotation speed to be as proportional as possible to the steering speed target value. It also improves the outer control loops (1) and (2), resulting in that the control of the rolling angle is made faster and more accurate to enhance the travel performance.

Although there may be a case for the steering angle speed control loop (3) to interfere with the free rotation of the front fork, i.e., the static autostability, the interference to some extent in the rotation of the front fork does not cause a problem because the later-described caster effect control means 51 carries out the same function instead. Thus, the above-described indirect advantages can be obtained by enabling to add the steering angle speed control loop (3).

Electrical Complementary System for Straight Traveling Property

Description of Configuration

Next, a description is given of the complementary function for the straight traveling property by the steering angle sensor 50 provided for improving the straight traveling property of the vehicle body in the neutral position and by the steering angle control loop (4) utilizing the caster effect control means 51.

The caster effect control means 51 calculates the caster effect addition amount d2 based on the steering angle obtained by the steering angle sensor 50 and outputs the addition amount d2 to the additive summary point 32.

Reference numeral 53 denotes the differentiation means which outputs the steering angle speed d1 as a differential value to the additive summary point 52.

A detailed example of the steering sensor is described hereinbelow.

Figure 10:
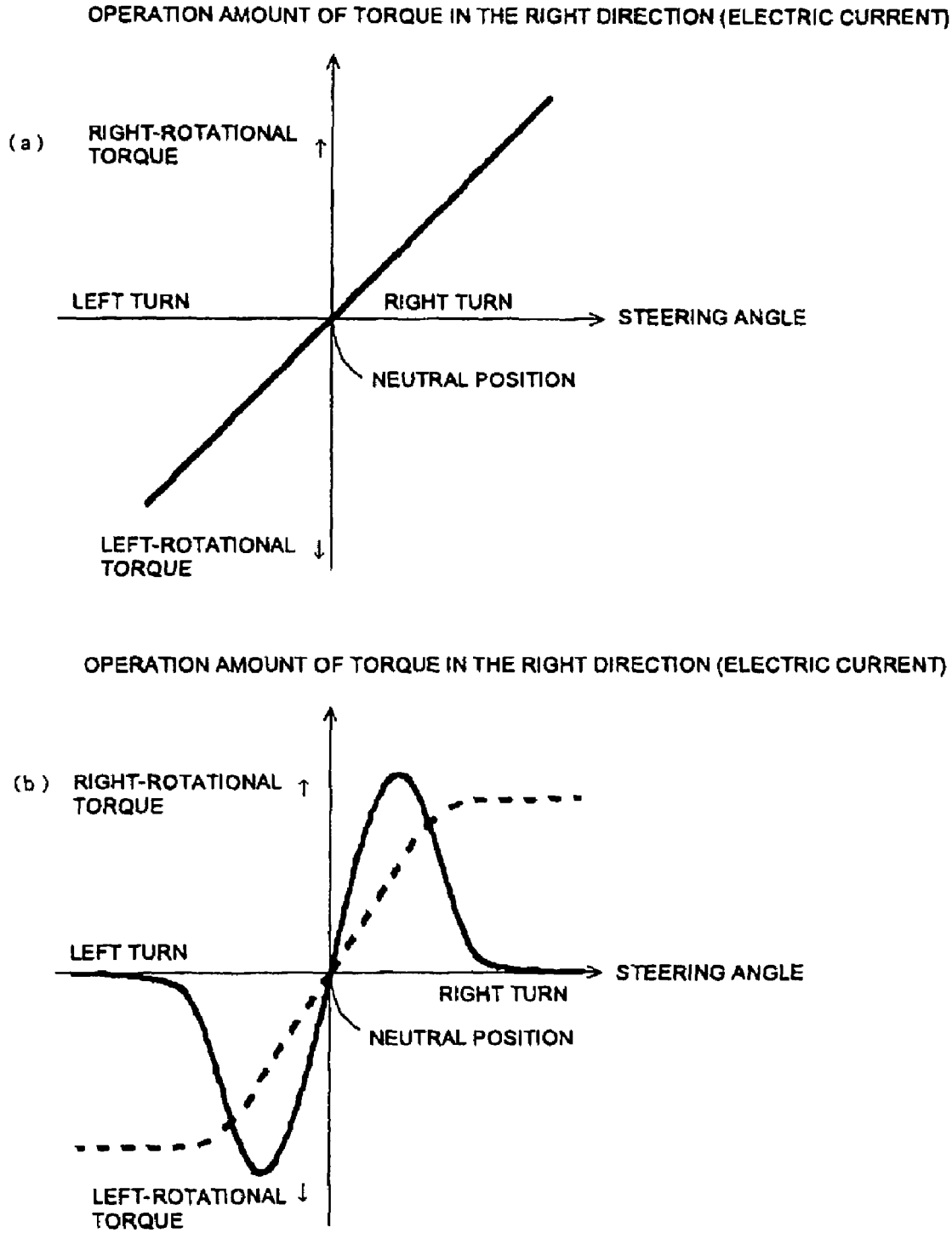
FIG. 10 is a characteristic view of a steering angle sensor.

FIGS. 10A and 10B show the examples of the control characteristics of the complementary function for the straight traveling property using the steering angle sensor 50, wherein abscissas denote "the steering angles" and ordinates denote "additive operation amounts of a rotational torque in the right direction (additive current)." Here, the control characteristics shown in FIGS. 10A and 10B are the input/output characteristics from the steering angle sensor 50 through the caster effect control means 51, and FIG. 10A shows the control characteristic in a case that the steering angle sensor 50 has the proportional output characteristic and also that the caster effect control means 51 is a proportional element.

That is, it is controlled so as to output the additive operation amount of the rotational torque in the right direction when the steering angle is positive (right turn) and output the additive operation amount of torque in the left direction when the steering angle is negative (left turn).

Using the potentiometer as the steering angle sensor results in that the change in the steering angle and the additive operation amount linearly correlate as shown in FIG. 10A when the caster effect control means 51 is the proportional element, while the control characteristic may be possible which can obtain the non-linearly correlation as indicated by a solid line or a dashed line in FIG. 10B by the caster effect control means 51 being a non-proportional element. When actuating the caster effect control means only while traveling straight, only the portion in the vicinity of the neutral position has an effect and the other portions where the steering angle is greater does not have an effect, thereby the control characteristics shown in FIG. 10B may be possible.

Various control characteristics other than those shown in FIGS. 10A and 10B may be realized by referencing a table or utilizing various functions to obtain an additional effect. For example, by adding an integral control element to the caster effect control means. 51, the effect to eliminate a steady-state deviation may be obtained.

Moreover, the steering angle sensor 50 may have the configuration enabling the detection of displacement in the left/right direction from the neutral position. Various configurations are possible such as, for example, the configuration wherein the support shaft 16 is made in conjunction with the rotation of the reduction gear 15 along with the rotation shaft of the potentiometer constituting the steering angle sensor 50 being continuously disposed to the support shaft 16, the configuration wherein the rotation shaft of the steering angle sensor 50 is attached to the upper end of the steering shaft 4 directly or via the rotation amount transmission device such as the gear, the configuration wherein the rotation shaft of the steering angle sensor 50 is continuously disposed to the motor shaft of the steering motor 13, or the configuration wherein the displacement of the handle arm 18 is detected.

Furthermore, various configurations of the steering angle sensor are of course possible such as the configuration wherein a magnetic sensor such as a Hall element and a magnet piece are combined instead of the rotary potentiometer of a resistance type, or the configuration wherein an optical sensor such as a phototransistor and an optical slit are combined. Depending on the attachment manner, a liner displacement sensor instead of a rotary displacement sensor may be used.

Description of Actions

When the steering shaft 4 is displaced slightly to either the left/right direction from the neutral position with the steering angle being 0°, the steering angle sensor 50 detects the steering angle of the steering shaft 4 and outputs a signal in response to the steering angle to the caster effect control means 51. The caster effect control means 51 calculates the caster effect addition amount d2 in response to the steering angle and outputs the addition amount d2 to the additive summary point 32.

Then, the operation amount 40 obtained by adding itself to the caster effect addition amount d2 based on the steering angle is output to the steering motor 13.

In this manner, the steering motor 13 will steer the steering shaft 4 further to the direction of displacement. Such operation makes the displacement of the steering angle greater so as to obtain a sufficient caster effect, thereby restoring the vehicle body from the inclined position to the upright position and the steering shaft 4 to the neutral position.

That is, when the vehicle body inclines, for example, to the right due to a disturbance or the like, the gyro effect and the influence by the angular velocity control loop (2) turn the front wheel to the right so as to moderate the angular velocity $\omega$, and to keep the rolling angle $\theta_r$ at the inclined condition to some extent, thereby bringing the vehicle body to the turning movement. At this time, the steering angle once comes into the steady turning condition at an angle consistent with the rolling angle $\theta_r$ (the angle based on the horizontal acceleration due to inertia and the gravitational acceleration) and the speed, although the right torque is applied by the caster effect and the influence of the above-described steering angle control loop (4) including the caster effect control means 51 to turn the vehicle body further to the right.

Thereby, the steady turning condition becomes unstable to restore the vehicle body from the inclined position to the upright neutral position.

In this manner, even if the angle control loop (1) is substantially halted especially when the error correcting operation is performed, the angular velocity control loop (2) and the steering angle control loop (4) cooperate to achieve the stable straight traveling condition of the vehicle body.

In this condition, since the steering angle is averagely neutral and in the straight traveling condition, wherein only the gravitational acceleration is affected without the horizontal acceleration being generated, it can be determined that, as for the two-wheeled vehicle grounded at only two points of the front and rear wheels, the vehicle body is in the upright position for maintaining balance with the gravitational acceleration. By utilizing this condition, the later-described error correction operation of the angular velocity $\omega$ obtained from the angular velocity sensor 22 and the rolling angle $\theta_i$ can be executed.

Here, the steering angle speed control loop (3) should be constantly activated since it directly works the actuator. The angle control loop (1) cannot contribute much to maintain the straight traveling condition because it resets or gradually resets the rolling angle output from the integration means when a 0 point adjustment is performed during traveling straight. Instead, the steering angle control loop (4) contributes to maintain the upright position and the straight traveling condition. Although, for this purpose, the angular velocity control loop (2) should be activated to maintain the dynamic stability, it does not interfere with the 0 point adjustment of the angular velocity because the adjustment is performed slowly.

The steering angle control loop (4) does not need to be activated during rolling, it should rather be inactivated except for during traveling straight by determining by, for example, the target value determination means because the loop generates the control error.

While the straight traveling condition should be assumed to be guaranteed by the rolling angle control operation when the rolling angle is 0°, the caster effect of the steering shaft. 4 can be electrically controlled by the control using the steering angle sensor, whereby complementing the straight traveling condition of the vehicle body is made possible by controlling electrically.

As described, it becomes possible to use the sensor system or the control system appropriately during traveling straight and rolling, which could not be readily achieved by the conventional technologies, to complement the disadvantages of each other, resulting in the following various advantages.

(1) When activating the steering angle control loop (4) only during traveling straight, the straight traveling condition can be enhanced greatly and accurately by increasing a gain from the caster effect control means or adding an integral control element.

(2) In contrast, since the design of the alignment around the front wheel of the vehicle body is allowed to be made optimum during rolling, the degree of freedom of design around the front wheel is advantageously enhanced.

It has been conventionally difficult to achieve both the straight traveling property and maneuverability only by mechanical correspondence, i.e., an American-type motorcycle with superior straight traveling property has poor maneuverability and a motorcycle with superior maneuverability has poor straight traveling property, although both properties can be achieved at high levels according to the present invention.

(3) The mechanism can be added for the steering angle speed to be proportional to the steering speed target value at a small expense to static autostability specific to the vehicle body, thereby it can achieve increased resistivity against a disturbance such as pebbles which directly affect the steering section as well as a decreased influence of the varying magnitude of the mechanical caster effect due to the changes in speed and surface resistance.

Moreover, the maneuverability is increased due to the enhanced reaction to the steering speed target value of the steering section.

In addition, the adjustment of the neutral point can be readily performed at the sensor position or on software.

Description of Flowchart

Figure 7:
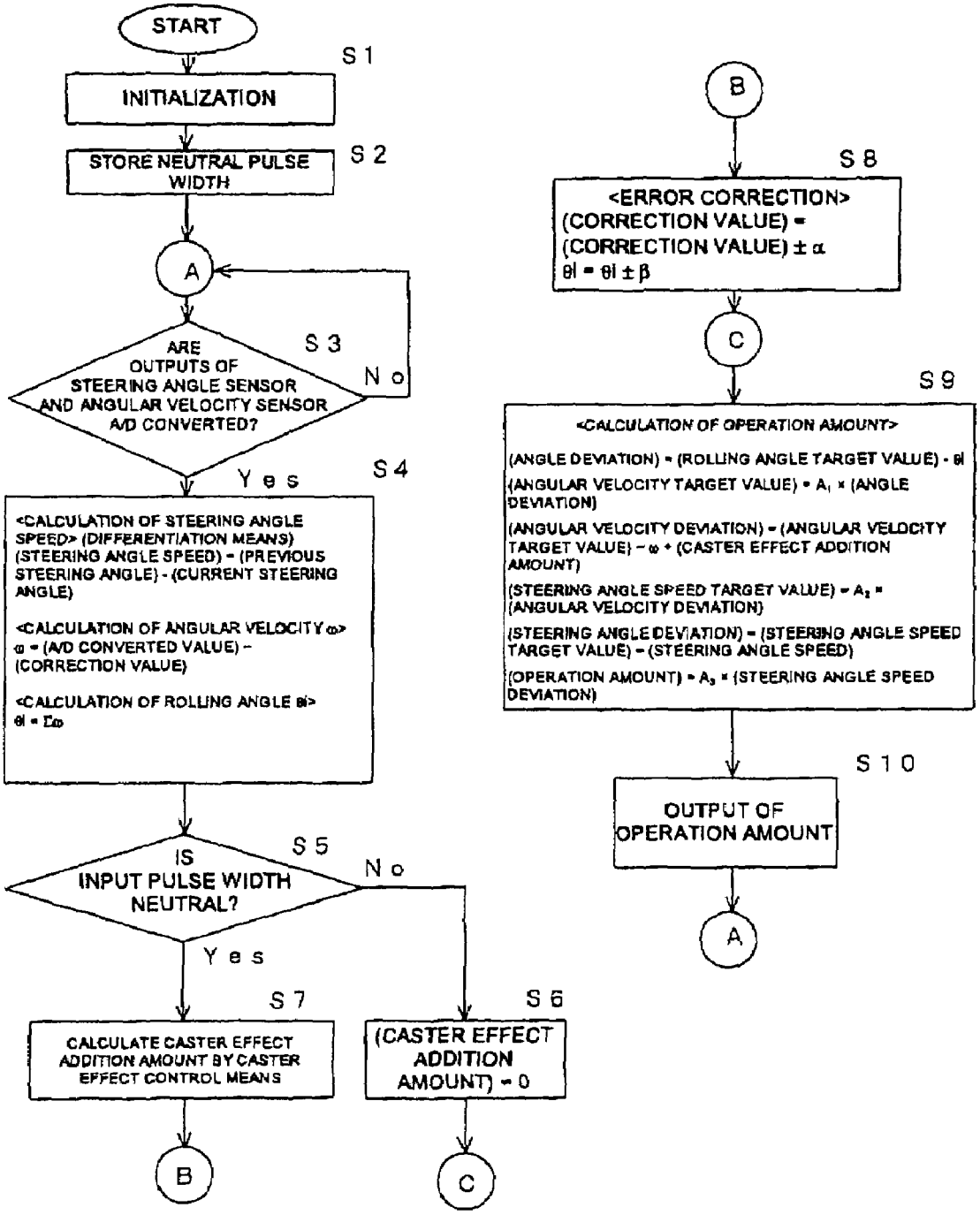
FIG. 7 is a flowchart showing an operation of the rolling angle control device.

Next, the operation of the rolling angle control device 21 is described in detail according to the flowchart of FIG. 7.

When the R/C transmitter (not shown) and the R/C receiver 3 are powered on (or when power sources are reset), the initialization of such as data is performed in Step 1.

In Step 2, the R/C receiver 3 receives the signal transmitted from the R/C transmitter (each of the operation sticks thereof is at the neutral position at this point) and then outputs the rolling angle target value indicating the rolling angle of 0° as the PWM signal 27, and the microcomputer 29 reads the pulse width of the output PWM signal 27 (the pulse width when the rolling angle target value is 0°: referred to as "a neutral pulse width" hereinbelow) by the timer within the microcomputer 29 to store it into the memory.

After the neutral pulse width is stored into the memory, the operator operates the respective operation sticks of the R/C transmitter to initiate the operation of the R/C model two-wheeled vehicle 1. At the same time, the output of the angular velocity sensor 22 begins to be input into the microcomputer 29 via the DC amplifier 28. The microcomputer 29 performs an A/D conversion of the analog input from the DC amplifier 28 at a constant frequency such as 1/500 second. Similarly, the A/D conversion of the output from the steering angle sensor 50 is also performed.

In Step S3, it is determined whether the A/D conversions of the output from the angular velocity sensor 22 which is input via the DC amplifier 28 and of the output from the steering angle sensor 50 are completed. The process stays in Step S3 if the A/D conversions are not yet completed, or proceeds to Step S4 if the A/D conversions are completed.

In Step S4, the angular velocity of rotation ω around the roll axis of the vehicle body 2 is calculated. Specifically, the angular velocity ω (the detected value) is obtained by subtracting the correction value (stored in the memory of the microcomputer 29) from the A/D converted value of the angular velocity sensor 22 output which was input via the DC amplifier 28. Here, since the output voltage of the angular velocity sensor 22 always has a certain output value (an offset), not zero, even when the angular velocity of the vehicle body 2 is actually zero, the subtraction of the correction value from the A/D converted value has to be performed to eliminate the amount corresponding to the offset.

Moreover, the A/D converted value of the steering angle sensor 50 output to obtain the steering angle speed is differentiated.

Furthermore, the calculated (detected) angular velocity ω to calculate the rolling angle $\theta_1$ of the vehicle body 2 (the integration operation) is integrated. Also, the rolling angle $\theta_i$ (the integral value of the integration means 34) obtained in Step S4 is stored into the memory within the microcomputer 29.

In subsequent Step S5, after reading the pulse width of the PWM signal 27 related to the rolling angle target value, which has been output from the R/C receiver 3 at that point, it is determined if the pulse width is equal to the neutral pulse width stored in the above-described Step S2 (that is, if the rolling angle target value received by the R/C receiver 3 is 0°) (the target value determination operation).

Then the process proceeds to Step S6 if the pulse width is determined to be different from the neutral pulse width, or proceeds to Step S7 if determined to be equal to the neutral pulse width.

Herein, the pulse width being equal to the neutral pulse width indicates that the pulse width falls within a predetermined range from a predetermined pulse width slightly smaller than the neutral pulse width to another predetermined pulse width slightly greater than the neutral pulse width; the pulse width being unequal to or different with the neutral pulse width indicates that the pulse width is out of the predetermined range. Similarly, the rolling angle target value being 0° indicates that the rolling angle target value falls within a predetermined range including 0°.

After branching to Step S6 at the rolling operation, the caster effect addition amount d2 is set to 0 (to stop the function of the caster effect control means) and then proceeds to Step 39.

In Step S9, the operation amount for the steering motor 13 is calculated based on the deviation between the rolling angle $\theta_i$ obtained in Step S4 and the rolling angle target value from the R/C receiver 3.

In subsequent Step S10, the signal corresponding to the operation amount calculated in Step S9 is output to the steering amplifier 30 and then returns to Step S3.

Description of Error Correction

Provided that the angular velocity sensor 22 has an ideal output characteristic of not causing a drift error and having the constant offset, the rolling angle $\theta_i$ detected (calculated) based on the output of the angular velocity sensor 22 becomes substantially equal to the actual rolling angle $\theta_r$ (see FIG. 4) of the vehicle body 2, thereby the closed loop control can be performed without a problem by regarding the rolling angle $\theta_i$ (the detected value) as the actual rolling angle $\theta_r$. However, the angular velocity sensor generally has a drift error due to variation in temperature or the like, especially the offset of the vibration gyro used as the angular velocity sensor 22 in this embodiment greatly changes due to the drift, so that the angular velocity ω (the detected value) obtained in Step S4 will gradually contain the error when the correction value in Step S4 is constant. Moreover, the rolling angle $\theta_i$ (the detected value) obtained in Step S5 for integrating the angular velocity ω will contain a greater error because the error contained in the angular velocity ω is also integrated. As a result, the rolling angle $\theta_i$ moves away from the actual rolling angle $\theta_r$, which may cause the uncontrollability.

Thus, in this control, the negative effect caused by the drift error is prevented from occurring by executing the error correction operation shown in Step S8 while the R/C model two-wheeled vehicle 1 is in the straight traveling condition. That is, under the condition where it is determined that the pulse width of the PWM signal 27 from the R/C receiver 3 equals the neutral pulse width (the rolling angle target value received by the R/C receiver 3 is 0°) in Step S5, it is considered that the vehicle body 2 is essentially traveling straight while maintaining the upright position where the rolling angle $\theta_r$ is substantially 0°, due to the function of the steering angle control loop (4) containing the caster effect control means 51 and the autostability obtained by the front wheel 6.

Therefore, the process proceeds from this condition to Step S8 through Step S7 for executing the following error correction operation to bring the angular velocity ω (detected value) obtained from the angular velocity sensor 22 output closer to zero and to bring the rolling angle $\theta_i$ (the integral value of the integration means 34) closer to 0°.

First, the caster effect addition amount d2 is calculated in Step S7 and then, in subsequent Step S8, "the 0 point adjustment" is performed to alter the correction value for eliminating the offset in response to the change in offset of the angular velocity sensor 22 output due to the drift. Specifically, a predetermined value a is added to or subtracted from the correction value used in Step S4. Whether to add or subtract the predetermined value α is determined based on the direction to decrease the absolute value |ω| of the angular velocity ω obtained in Step S4. That is, the predetermined value α is added to the original correction value if adding the predetermined value α decreases the absolute value |ω|, and, in contrast, if adding the predetermined value α increases the absolute value |ω|, the predetermined value α is subtracted from the original correction value. Thus, the obtained value from addition/subtraction is stored in the memory within the microcomputer 29 as the new correction value. In this manner, the 0 point is shifted in the direction to decrease the angular velocity ω which will be calculated next in Step S4.

In addition, the predetermined value α is set to the value of velocity which is sufficient to correct the error of the angular velocity ω due to the assumed drift of the angular velocity sensor 22 and is not unnecessarily large. Thereby, the angular velocity ω will gradually become closer to zero while repeating Step S8 and Step S4 several times.

On the other hand, as for the rolling angle $\theta_i$, a predetermined value β is added to or subtracted from the rolling angle $\theta_i$ (the integral value) calculated in Step S4. Whether to add or subtract the predetermined value β is determined based on the direction to decrease the absolute value $|\theta_i|$ of the rolling angle $\theta_i$ obtained in Step S4. That is, the predetermined value β is added to the original rolling angle $\theta_i$ if adding the predetermined value β decreases the absolute value $|\theta_i|$, and, in contrast, if adding the predetermined value β increases the absolute value $|\theta_i|$, the predetermined value β is subtracted from the original rolling angle $\theta_i$. Thus, the obtained value from addition/subtraction is stored in the memory within the microcomputer 29 as the new rolling angle $\theta_i$.

In addition, the predetermined value β is set to the value which is able to gradually eliminate the detected value of the angular velocity ω being accumulated in the integration means 34 due to the drift of the angular velocity sensor 22 at that point and the error having been accumulated in the integration means 34 before performing the error correction operation. Thereby, the rolling angle $\theta_i$ will gradually become closer to 0° while repeating Step S8 several times.

The reason for applying such a configuration to bring the angular velocity ω gradually closer to zero as well as bringing the rolling angle $\theta_i$ gradually closer to 0° is, by making the corrections gradually, to maintain the function of the angular velocity control loop (2) for the angular velocity ω and to maintain the effect of integral compensation for the angular velocity control loop (2) for the rolling angle $\theta_i$.

In addition, when the drift of the angular velocity sensor 22 is large, it may be configured so that the rolling angle $\theta_i$ will be quickly reset to 0° by passing through Step S8 with the predetermined value β being relatively large to make the angle control loop (1) ineffective. This is to prevent the amount of errors accumulated while the error correction operation is not yet performed from becoming larger than the angular velocity ω due to the rolling angle being obtained by integrating the angular velocity ω, and to prevent the influence by the error of the angular velocity ω while performing the error correction operation being enhanced due to the integrating effect.

As described above, forcing the rolling angle $\theta_i$ to 0° leads to the angle deviation being constantly 0°, resulting in that the angle control loop (1) becomes substantially ineffective, although the straight traveling condition is maintained by the function of the steering angle control loop (4) containing the caster effect control means 51 which cooperates with the angular velocity control loop (2) and by the autostability (especially the caster effect) specific to the vehicle body.

Moreover, although not shown in FIG. 7, as well as the error correction operation being performed on the software in Step S8, a drift/offset correcting output (shown by reference numeral 43 in FIG. 5) is provided on the hardware from the microcomputer 29 to the DC amplifier 28. This operation is realized by an analog output function of the microcomputer 29 and a 0 point correction function of the DC amplifier 28, which is an accurate rough correction operation performed for the purpose of preventing input saturation on the microcomputer 29 side by decreasing a bias component contained in the output from the DC amplifier 28.

After modulating the correction value and the rolling angle $\theta_i$ as described above in Step S8, the process proceeds to Step S9 to calculate the operation amount in the same manner with the case where the process proceeds from Step S5 and Step S6 to Step S9, then proceeds further to Step S10 and returns to Step S3.

As described above, the rolling angle control device 21 mounted on the R/C model two-wheeled vehicle 1 in this embodiment takes the rolling angle of the vehicle body 2 instead of the steering angle of the front wheel 6 as the control amount to perform the control to bring the control amount closer to the target value, therefore the R/C model two-wheeled vehicle 1 can be controlled with stability as long as the values of the above-described proportionality constants $A_1$, $A_2$, and $A_3$ are appropriately set.

That is, the rolling angle control device 21 of this embodiment is further provided with the angular velocity control loop (2) as well as the angle control loop (1), wherein the operation amount is output to the steering motor 13 corresponding to the angular velocity deviation calculated using the angular velocity ω (the detected value) fed back by the angular velocity control loop (2), thereby the dynamic stability can be achieved which increases/decreases the angular velocity ω of rolling of the vehicle body 2 in response to the degree of the angle deviation. Furthermore, this effect along with the gyro effect of the front wheel 6 prevents the oscillation (hunting) of the vehicle body 2 around the rolling shaft.

Figure 4:
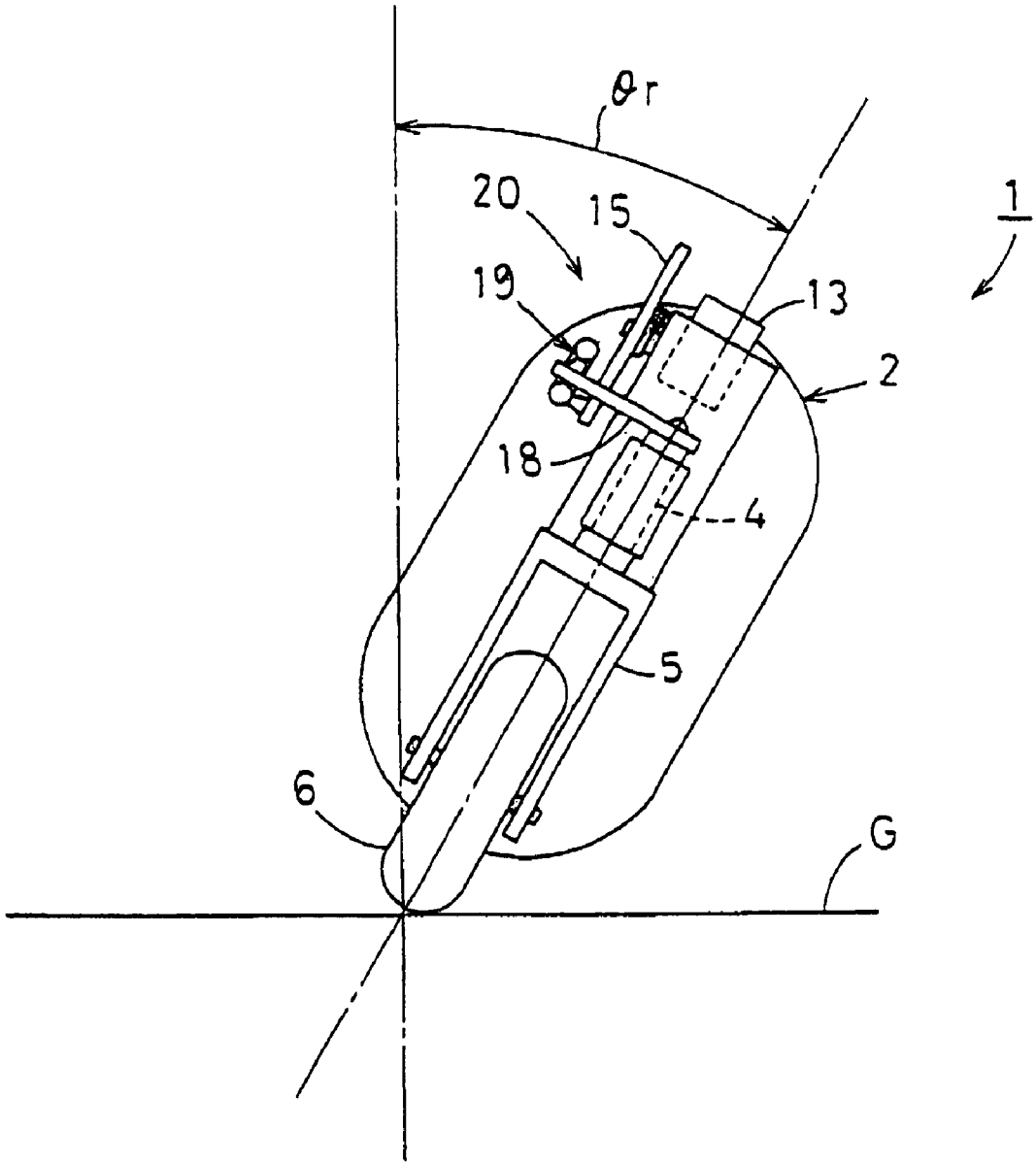
FIG. 4 is a front view of the R/C model two-wheeled vehicle showing its rotational traveling state.

On the other hand, in a case that the R/C model two-wheeled vehicle 1 in the straight traveling condition is turned left for example, by the operator operating the operation stick for adjusting the rolling angle of the R/C transmitter to tilt to the left at a desired angle, the torque is applied from the steering motor 13 to the steering shaft 4 for turning the front wheel 6 first to the right and for tilting the vehicle body 2 to the left. If the vehicle body 2 is about to tilt to the left beyond the rolling angle target value, the torque is applied for turning the front wheel 6 to the left to prevent the tilting motion of the vehicle body 2, and the rolling angle $\theta_i$ of the vehicle body 2 is controlled to be restored finally to the angle consistent with the rolling angle target value. Thereby, the vehicle body 2 rolls to the left (to the right when viewed from the front side) at the rolling angle $\theta_r$ ($\cong\theta_i$) as shown in FIG. 4, resulting in the vehicle body 2 turning to the left at the turning radius automatically determined by the rolling angle $\theta_r$ and the speed.

Moreover, when the operation stick for adjusting the rolling angle of the R/C transmitter is restored to the neutral position from the above-described left-turning condition for example, the rolling angle target value becomes 0° and thus the angle deviation is generated between that and the rolling angle $\theta_i$ of the vehicle body 2. Therefore, the torque is applied from the steering motor 13 to the steering shaft 4 for turning the front wheel 6 first to the left and for raising the vehicle body 2, and the torque is applied for turning the front wheel to the right to prevent the tilting motion of the vehicle body 2 if the vehicle body 2 is about to tilt to the right beyond the upright position and then the rolling angle of the vehicle body 2 is controlled to be restored finally to substantially 0° for the straight traveling condition.

Additionally, in this embodiment, the turning radius of the R/C model two-wheeled vehicle 1 (the steering angle of the front wheel 6) itself is not controlled directly, and the speed of the R/C model two-wheeled vehicle 1 is not affected by the rolling angle control operation. However, when the setting is such that the gyro effect of the front wheel may affect the steering angle speed as the disturbance, due to the gyro effect of the front wheel 6 becoming greater proportional to the speed, the change amount (the gain) of the steering angle of the front wheel 6 against the current output to the steering motor 13 (i.e., the rotational torque applied to the steering shaft 4) becomes smaller inversely proportional to the speed and in contrast the change amount (the gain) of the angular velocity of the vehicle body 2 around the rolling shaft against the change in the steering angle of the front wheel 6 becomes greater proportional to the speed. The changes of these two gains due to the speed cancel each other out, so that stable posture control can be achieved in a wide speed range without actually detecting the speed and taking it into consideration.

Additionally, when the setting is such that the gyro effect of the front wheel does not affect the steering angle speed as the disturbance, the posture control may be achieved by actually detecting the speed and taking it into consideration.

Moreover, when the rolling angle target value is 0°, the vehicle body 2 tends to maintain essentially the upright position where the rolling angle $\theta_r$ is substantially 0° by the function of the steering angle control loop (4), therefore, by utilizing this tendency, the error correction operation described in relation to Step S8 of FIG. 7 is automatically performed. Thereby, the negative effect due to the drift error of the angular velocity sensor 22 can be prevented without stopping the R/C model two-wheeled vehicle 1. This in turn enables the R/C model two-wheeled vehicle 1 to travel continuously for a long time.

Although, in the above-described embodiment, the error correction operation is made to be performed only when the rolling angle target value having been received by the R/C receiver 3 is 0°, the negative effect for the control due to the drift of the angular velocity sensor 22 can be prevented even in the configuration where, in FIG. 6, for example, a high-pass filter is disposed on the output side of the angular velocity sensor 22 and a predetermined value is always subtracted from the integral value of the integration means 34 to have an incomplete integral, wherein such a configuration is advantageous because it can be achieved even in an analog circuit However, since the slow angular velocity cannot be detected in this case, there arises a tendency where the rolling angle of the turning vehicle body gradually displaces due to the auto-stability and other disturbances.

Binary Sensor

The steering angle sensor does not need to output the linear signal in response to the steering angle, so that anything can complement the straight traveling property as long as it is able to detect to which at least the neutral point as a boundary the steering angle is turned left or right. In this case, various optical sensors or binary sensors such as a magnetic switch can be used.

Figure 9:
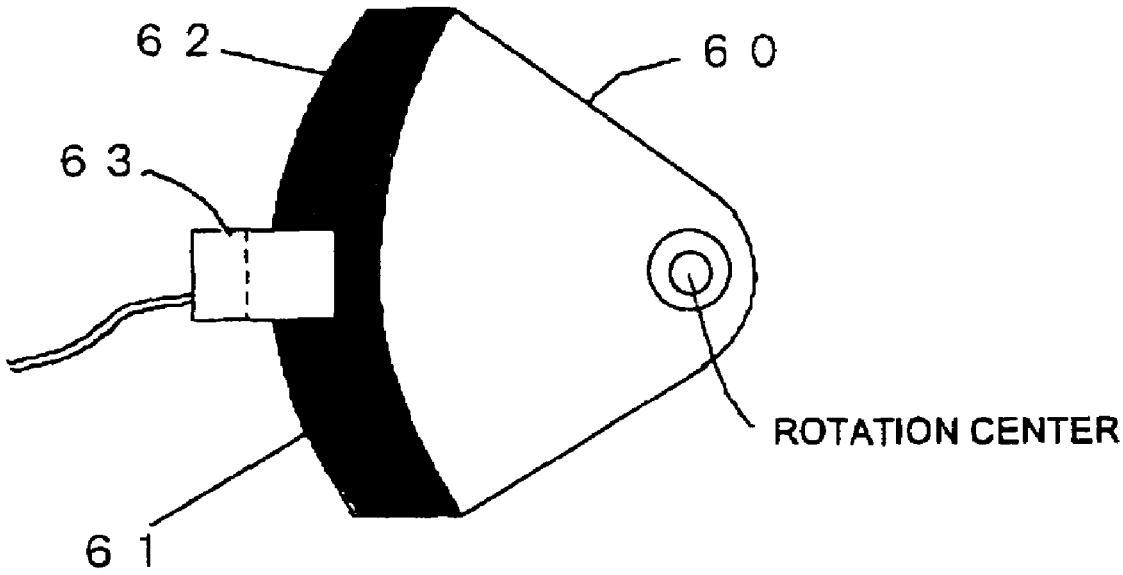
FIG. 9 is a plan view of a configuration example of a binary sensor.

For example, as shown in FIG. 9, the configuration can be used wherein a rotary plate 60 pivotally rotates in conjunction with the steering shaft is disposed, a transparent portion 61 which transmits light and an opaque portion 62 which does not transmit light are disposed on the periphery of the rotary plate 60, and a photo interrupter 63 is placed at the boundary border in the straight traveling condition of the transparent and opaque portions 61 and 62.

Figure 11:
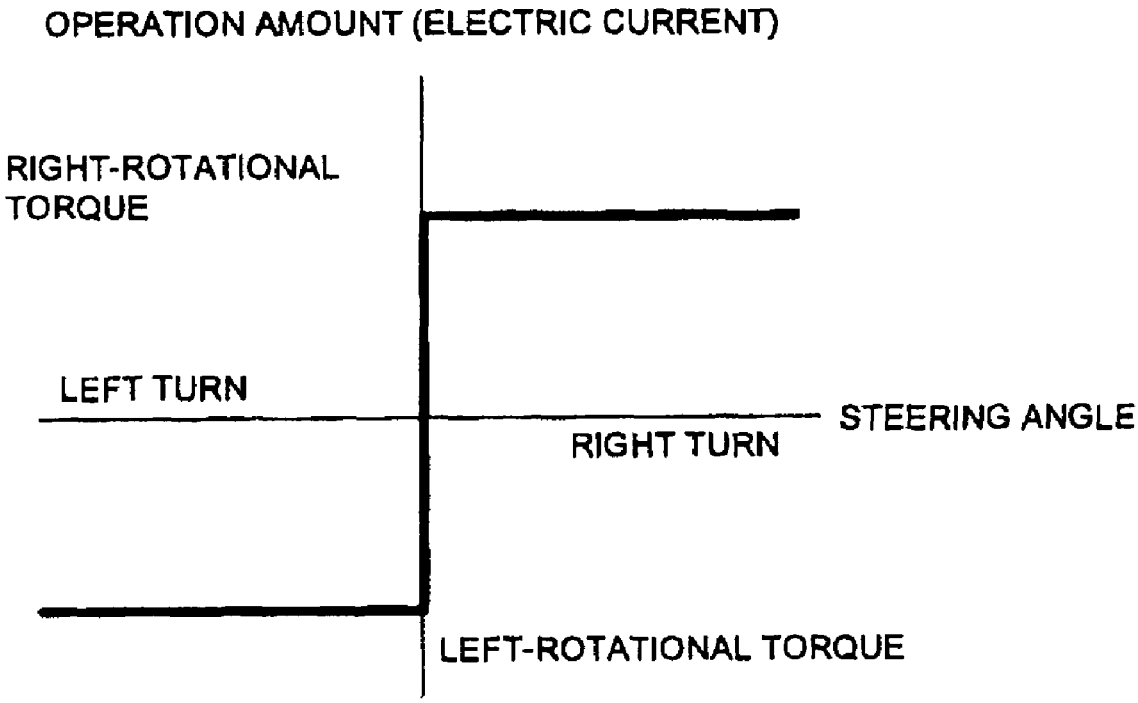
FIG. 11 is a characteristic view of the binary sensor.

At this time, in a case that the caster effect control means 51 is the proportional element, a predetermined right-rotational torque is applied when the steering angle is turned right and a predetermined left-rotational torque is applied when turned left, as shown in FIG. 11. In this case as well, the integral control element maybe added to the caster effect control means 51.

Figure 12:
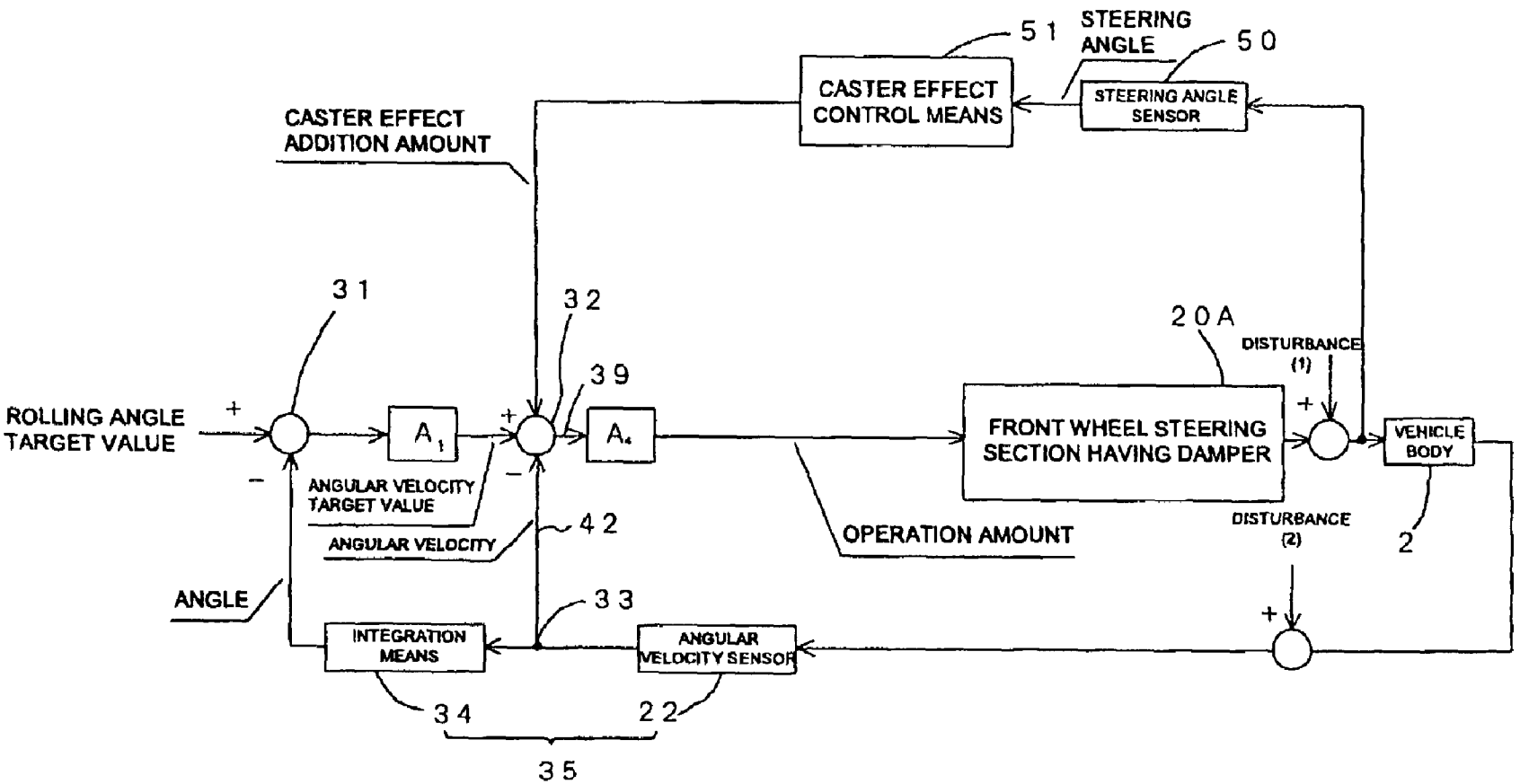
FIG. 12 is a block diagram illustrating a controlling operation of another embodiment.

When such a binary sensor is used, a block diagram shown in FIG. 12 is formed because the application of the differentiation means shown in FIG. 6 is inappropriate.

Since the block diagram in FIG. 12 has the same configuration with that in FIG. 6 except for not being provided with the steering angle speed control loop (3) in FIG. 6, the description thereof is omitted.

Figure 13:
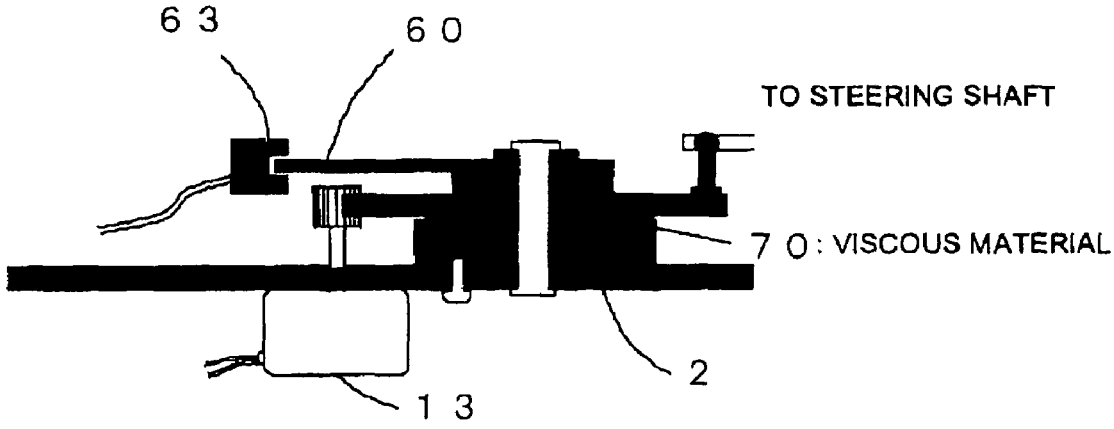
FIG. 13 is a cross-sectional side view of an example of a front wheel steering section having a damper.

Next, a detailed example of the front wheel steering section 20A having the damper is described by referring to FIG. 13.

The front wheel steering section 20A having the damper is provided with the steering motor 13 secured to the frame of the vehicle body 2, the gear 15 driven by the steering motor 13, and the rotary plate 60 disposed so as to pivotally rotate in conjunction with the gear 15, wherein the photo interrupter 63 as the steering angle sensor is secured to the vehicle body 2 to detect the transparent and opaque portions formed on the periphery of the rotary plate 60 in the same manner as shown in FIG. 9. Moreover, a viscous material 70 is filled between the gear 15 and the frame of the vehicle body 2, thereby imparting a damper function to dampen the rapid rotation of the gear 15. Furthermore, the steering shaft is connected to the gear 15 by a link or the like in conjunction therewith.

Here, since the rotation of the gear 15 is dampened by the viscous material 70, the gear 15 rotates at the angular velocity substantially proportional to the rotational torque of the steering motor. Thus, if the steering motor has the characteristic to generate the rotational torque substantially proportional to the operation amount, the steering motor rotates at the rotational torque substantially proportional to the operation amount, and in turn the gear 15 and the steering shaft rotate at the angular velocity substantially proportional to the rotational torque, thereby the steering angle speed of the steering shaft can be controlled to be substantially proportional to the operation amount even when the binary sensor such as the photo interrupter is used.

In addition, the adjustment of the neutral point in this case can be readily achieved by shifting the position of the photo interrupter 63.

ILLUSTRATION OF OTHER EXAMPLES

In a Case that Angle Sensor and Angular Velocity Sensor are Separately Disposed

Figure 8:
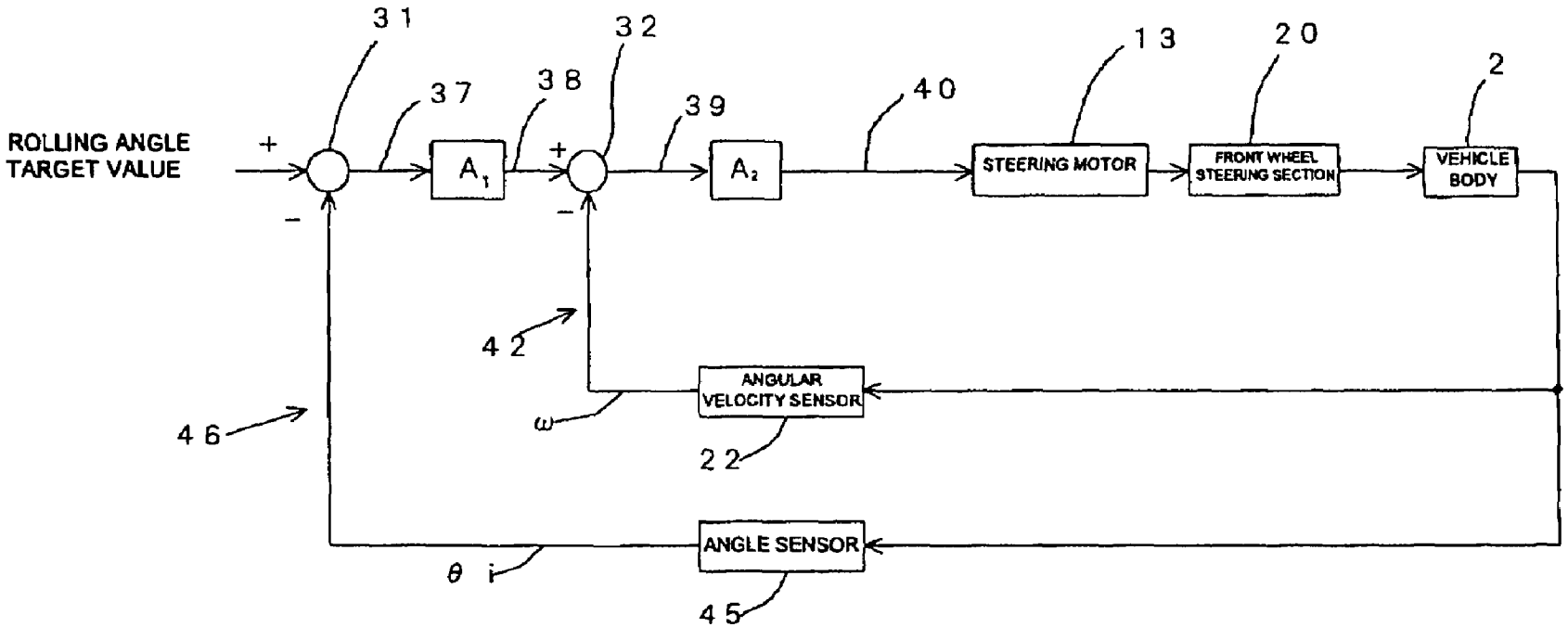
FIG. 8 is a block diagram illustrating another embodiment of the rolling angle control device.

Moreover, although the rolling angle detection means 35 in the above-described embodiment is configured by the angular velocity sensor 22 and the integration means 34 to integrate the angular velocity $\omega$ obtained from the output of the angular velocity sensor 22, the effect to stably control the posture in a wide speed range can be achieved by disposing the angle sensor 45 as the rolling angle detection means to directly detect the rolling angle of the vehicle body 2 separate from the angular velocity sensor 22 and configuring the angle control loop (4) to feed back the rolling angle $\theta_i$ detected by the angle sensor 45 to the additive summary point 31, as shown, for example, in FIG. 8 (the steering angle speed control loop (3) and the steering angle control loop (4) are not shown).

In addition, instead of the above-described vibration gyro, an optical fiber gyro, a mechanical gyro, a gas rate gyro or the like may be used as the angular velocity sensor 22.

Description for Obtaining Angular Velocity by Differentiating Rolling Angle

Description for Obtaining Steering Angle by Integrating Steering Angle Speed

Instead of the steering angle sensor shown in FIG. 6, the configuration is possible wherein a detection means such as a dynamo able to detect the steering angle speed is disposed, the detected steering angle speed is added at the additive summary point 52, and the steering angle obtained by integrating the detected steering angle speed is input to the caster effect control means 51.

Other Examples

Although the steering motor 13 is used as the steering actuator in the above-described examples, the steering actuator other than the motor can be, of course, applied.

Moreover, the mechanism for transmitting the force of the steering actuator to the steering shaft 4 or the front fork 5 is not limited to those described above, any mechanism can be applied as long as it satisfies the condition of not interfering with the rotation of the front fork 5.

Furthermore, the means to perform the remote control is not limited to the R/C control using the radio wave.

In addition, the rolling angle control device of the present invention can also be applied to a full-scale ridable two-wheeled vehicle as well as the model of the two-wheeled vehicle. In this case, it is configured so that the signal is directly input to the rolling angle control device without using the R/C receiver. With this configuration, the two-wheeled vehicle can be controlled by the rolling angle control device instead of by a human who is unable to recognize the rolling angle accurately, thereby enhanced maneuverability and safety can be achieved.

Furthermore, the signal which is input to the rolling angle control device is not limited to the PWM signal, various digital signals such as a PCM signal or an analog voltage signal can be applied.

Straight Traveling Complementation by Magnet or Elastic Body

Characteristics

Next, the characteristics of the rolling angle control device of the present invention are summarized.

Primarily, to control the R/C two-wheeled vehicle, the function to recognize the direction of the gravitational acceleration such as a clinometer (a gravity sensor) is required to control the posture of the straight traveling two-wheeled vehicle and to determine the reference of the rolling angle when rolling, although the clinometer utilizing a weight or an accelerometer is not suitable for the dynamic control of such as the traveling two-wheeled vehicle because an error is generated when the horizontal acceleration is applied. Thus, an inclination recognition means is required which is dynamically usable and has a good frequency characteristic.

On the other hand, for controlling the posture of the two-wheeled vehicle body when rolling, an angle and angular velocity detection function having quick responsiveness (having a good frequency characteristic) such as various gyro sensors is required to recognize a change in the posture of the vehicle body quickly, although an error needs to be corrected because the gyro cannot elude the generation of the drift error due to a change in temperature or an error due to the earth's rotation, and a means is required to provide the reference condition such as the upright position of the vehicle body for correcting the error.

Therefore, in the present invention, it is achieved that the rolling angle control device automatically recognizes the "straight traveling" operation being performed by the simple steering angle detection means and the rolling angle control means using the gyro and transfer to the control mode which electrically complement the straight traveling property of the vehicle body, and maintains the upright position of the vehicle body when traveling straight with higher accuracy than that of the conventional techniques.

Since, in the straight traveling condition maintained by the rolling angle control means of the present invention, only the gravitational acceleration is affected without the horizontal acceleration being generated, it can be determined that, as for the two-wheeled vehicle grounded at only two points of the front and rear wheels, the vehicle body is in the upright position for maintaining balance with the gravitational acceleration.

That is, the upright position of the vehicle body during traveling straight can be recognized even indirectly by the highly accurate posture control, not only by the single sensor, and the change in posture from the upright position during rolling can be recognized by the gyro having a good frequency characteristic, meaning that nothing more or less than the dynamically usable inclination recognition means having a good frequency characteristic is substantially achieved. In the present invention, it is characterized in that, while utilizing the characteristic specific to the two-wheeled vehicle and reasonable cooperation with the dual control system characterized by the two kinds of sensors, the rolling angle control is performed by the inclination recognition means having a substantially good frequency characteristic.

Moreover, since the partial control loops such as the angular velocity control loop are commonly used in the control mode for traveling straight and in the control mode for rolling, the overall configuration is efficient and reasonable compared to the control system which is configured to be completely separate for both modes, the transition to the other mode can be performed smoothly without being recognized by the operator, thereby the extremely superior maneuverability can be achieved.

INDUSTRIAL APPLICABILITY

As described above, according to the rolling angle control device of the present invention, the rolling angle of the R/C two-wheeled vehicle is detected and the detected rolling angle value is controlled so as to bring it closer to the rolling angle target value, and the device can facilitate the control of the vehicle by the operator and stabilize the posture of the R/C two-wheeled vehicle in a wide speed range from low speed to high speed.

Moreover, the electrical caster effect control means is configured to detect to which at least the neutral point as a boundary the steering angle is turned left or right so as to apply the right-rotational torque when the steering angle is in the right direction or to apply the left-rotational torque when the steering angle is in the left direction, such that the straight traveling property of the R/C two-wheeled vehicle can be supported electrically to provide a stable traveling property.

Furthermore, according to the present invention, the error correction is performed while maintaining the straight traveling property when the rolling angle target value is determined to be 0°, so as to prevent negative control effects due to the drift error of the angular velocity sensor without stopping the R/C two-wheeled vehicle. An advantage can also be achieved whereby expensive sensors such as a ring laser gyro are not required for detecting the upright condition of the R/C two-wheeled vehicle.

The invention claimed is:

1. A rolling angle control device for a remote-controlled two-wheeled vehicle, the remote-controlled two-wheeled vehicle having a vehicle main body, a steering shaft supported on a front section of the vehicle main body at a predetermined caster angle, a front fork supporting a front wheel and being pivotally rotatable around the steering shaft, a steering actuator for applying a rotational torque to the steering shaft or the front fork in either of a left direction or a right direction, a rear wheel disposed at a rear section of the vehicle main body and being rotationally drivable by a prime motor, a steering angle detector for detecting at least whether a steering angle of the remote-controlled two-wheeled vehicle is to the left direction or the right direction, and a remote control receiver mounted on the vehicle main body, the rolling angle control device comprising:

a rolling angle detector for detecting the rolling angle of the vehicle main body, the rolling angle being the angle by which the two-wheeled vehicle deviates from vertical; and a controller for outputting an operation amount for the steering actuator based on the rolling angle detected by the rolling angle detector and a rolling angle target value from the remote control receiver so as to bring the rolling angle closer to the rolling angle target value, wherein the controller is configured to apply a signal to the operation amount for the steering actuator, the signal indicating that a right-rotational torque is to be applied to the steering shaft or the front fork via the steering actuator when the steering angle detected by the steering angle detector is in the right direction, or indicating that a left-rotational torque is to be applied to the steering shaft or the front fork via the steering actuator when the steering angle detected by the steering angle detector is in the left direction.

2. A rolling angle control device for a remote-controlled two-wheeled vehicle, the remote-controlled two-wheeled vehicle having a vehicle main body, a steering shaft supported on a front section of the vehicle main body at a predetermined caster angle, a front fork supporting a front wheel and being pivotally rotatable around the steering shaft, a steering actuator for applying a rotational torque to the steering shaft or the front fork in either of a left direction or a right direction, a rear wheel disposed at a rear section of the vehicle main body and being rotationally drivable by a prime motor, a steering angle detection means for detecting at least whether a steering angle of the remote-controlled two-wheeled vehicle is to the left direction or the right direction, and a remote control receiver mounted on the vehicle main body, the rolling angle control device comprising:

a rolling angle detection means for detecting the rolling angle of the vehicle main body, the rolling angle being the angle by which the two-wheeled vehicle deviates from vertical;

a rolling angle control means for outputting an operation amount for the steering actuator based on the rolling angle detected by the rolling angle detection means and a rolling angle target value from the remote control receiver so as to bring the rolling angle closer to the rolling angle target value;

a target value determination means for determining whether the rolling angle target value received by the remote control receiver is 0°; and a caster effect control means for generating a signal for the steering actuator, the signal indicating that a right-rotational torque is to be applied to the steering shaft or the front fork via the steering actuator when the steering angle detected by the steering angle detection means is in the right direction, or indicating that a left-rotational torque is to be applied to the steering shaft or the front fork via the steering actuator when the steering angle detected by the steering angle detection means is in the left direction, wherein the signal generated by the caster effect control means is added to the operation amount output by the rolling angle control means at least when the target value determination means determines that the rolling angle target value is 0°.

* * * * *